US012656006B2

(12) United States Patent
Hermann et al.

(10) Patent No.: US 12,656,006 B2
(45) Date of Patent: Jun. 16, 2026

(54) DEVICE AND METHOD FOR DETECTION OF ELECTRICAL DISCHARGE IN AN HVAC CONTROL BOX

(71) Applicant: Carrier Corporation, Palm Beach Gardens, FL (US)

(72) Inventors: Theodore Hermann, Eden Prairie, MN (US); Benjamen Baker, New Haven, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 212 days.

(21) Appl. No.: 18/395,567

(22) Filed: Dec. 24, 2023

(65) Prior Publication Data

US 2024/0219051 A1 Jul. 4, 2024

Related U.S. Application Data

(60) Provisional application No. 63/477,648, filed on Dec. 29, 2022.

(51) Int. Cl.
*F24F 11/32* (2018.01)
*F24F 11/52* (2018.01)
*F24F 11/88* (2018.01)

(52) U.S. Cl.
CPC ..... *F24F 11/32* (2018.01); *F24F 11/52* (2018.01); *F24F 11/88* (2018.01)

(58) Field of Classification Search
CPC .. F24F 11/32; F24F 11/38; F24F 11/52; F24F 11/88; F24F 2140/00; F24F 2140/60; F24F 2130/40; G01H 17/00; G01R 31/00
See application file for complete search history.

(56) References Cited

U.S. PATENT DOCUMENTS

| | | | | |
|---|---|---|---|---|
| 8,054,591 | B2 | 11/2011 | Changali et al. | |
| 9,304,111 | B2 | 4/2016 | Cheng et al. | |
| 9,366,713 | B2 | 6/2016 | Zach | |
| 9,869,709 | B2 | 1/2018 | Beihaja et al. | |
| 10,013,865 | B2 | 7/2018 | Stock et al. | |
| 10,281,515 | B2 | 5/2019 | Huang et al. | |
| 10,317,454 | B2 | 6/2019 | Perichon | |
| 10,359,466 | B2 | 7/2019 | Alberto et al. | |
| 10,690,713 | B2 | 6/2020 | Alberto et al. | |
| 2008/0033600 | A1* | 2/2008 | Norbeck | F24F 11/30 700/107 |
| 2009/0248329 | A1 | 10/2009 | Restrepo | |

(Continued)

FOREIGN PATENT DOCUMENTS

| | | | |
|---|---|---|---|
| EP | 3929600 | A1 | 12/2021 |
| WO | 2011090464 | A1 | 7/2011 |
| WO | 2020084297 | A1 | 4/2020 |

*Primary Examiner* — Adnan Aziz
(74) *Attorney, Agent, or Firm* — Souad Hakim

(57) ABSTRACT

A device and method for the detection of electrical discharge in an HVAC control box are disclosed. The device comprises an ultrasonic sensor(s) such as a MEMS-based sensor that detects the acoustic spectrum(s) generated within the HVAC control box, and a processing unit in communication with the ultrasonic sensor. The processing unit is configured to receive, from the ultrasonic sensor, the acoustic spectrum being detected within the HVAC control box and analyze the received acoustic spectrum to detect an electrical discharge within the HVAC control box.

20 Claims, 3 Drawing Sheets

(56) References Cited

U.S. PATENT DOCUMENTS

| | | | | |
|---|---|---|---|---|
| 2014/0266755 | A1* | 9/2014 | Arensmeier | F24F 11/49 340/679 |
| 2016/0341782 | A1* | 11/2016 | Huang | G01R 31/1209 |
| 2019/0003734 | A1* | 1/2019 | Costa | F24F 11/38 |
| 2019/0079132 | A1 | 3/2019 | Chine et al. | |
| 2020/0400736 | A1* | 12/2020 | Severns | G01R 17/10 |
| 2021/0405106 | A1 | 12/2021 | Hencken et al. | |
| 2022/0018887 | A1* | 1/2022 | Hencken | G01R 31/3271 |
| 2022/0163578 | A1* | 5/2022 | Marshall | G01R 31/001 |
| 2022/0412589 | A1* | 12/2022 | Palmer | F24F 11/30 |

* cited by examiner

DEVICE AND METHOD FOR DETECTION OF ELECTRICAL DISCHARGE IN AN HVAC CONTROL BOX

CROSS-REFERENCE TO RELATED APPLICATION

This patent application claims the benefit of U.S. Provisional Patent Application No. 63/477,648, filed on Dec. 29, 2022, which is incorporated by reference herein in its entirety.

BACKGROUND

This invention relates to the field of arc detection systems, and more particularly, a device and method for detection of electrical discharge in a heating, ventilation, and air conditioning (HVAC) control box.

HVAC control boxes may be used with HVAC systems that are generally implemented for rooftop and chiller applications. HVAC control boxes may switch high power loads that may cause a thermal event if an electrical discharge (arc) is generated in the HVAC control box during the switching operation of loads connected to the HVAC control box. The electrical discharge may ignite any material within the control box leading to a fire hazard. While the control box may be typically designed to contain a potential thermal event/fire hazard, the electrical discharge events may cause injury to service technicians and may lead to significant costs for both manufacturer and owner. While manufacturers work to identify root cause, this is typically very challenging to determine without the event timing and equipment operational status during the electrical discharge event.

SUMMARY

Described herein is a device for detection of electrical discharge in an HVAC control box. The device comprises one or more ultrasonic sensor(s) operable to detect one or more acoustic spectrum(s) within the HVAC control box, and a processing unit in communication with the one or more ultrasonic sensor. The processing unit comprises a processor and may be coupled to a memory device storing instructions executable by the processor, wherein the processing unit is configured to: receive, from the one or more ultrasonic sensor(s), the one or more acoustic spectrum(s) being detected within the HVAC control box; and analyze the received acoustic spectrum to detect an electrical discharge within the HVAC control box.

In one or more embodiments, the processing unit is configured to match the received acoustic spectrum with pre-stored acoustic spectrums associated with one or more known electrical discharge conditions, and correspondingly detect an electrical discharge event within the HVAC control box upon a positive matching.

In one or more embodiments, the ultrasonic sensor is a micro-electro-mechanical system (MEMS) based ultrasonic microphone.

In one or more embodiments, the device comprises a data recorder in communication with the processing unit, wherein the processing unit stores log data comprising one or more of the acoustic spectrum being detected within the HVAC control box, the corresponding detected electrical discharge event, and time stamp and duration of the detected electrical discharge event, in the data recorder.

In one or more embodiments, the data recorder is outside the HVAC control box.

In one or more embodiments, the device comprises an alert generation unit in communication with the processing unit, wherein the processing unit transmits a set of alert signals to the alert generation unit upon detection of the electrical discharge event within the HVAC control box.

In one or more embodiments, the device is configured to transmit a set of alert signals to one or more mobile devices associated with one or more users upon detection of the electrical discharge event within the HVAC control box.

In one or more embodiments, the device is in communication with a controller of the HVAC control box, wherein upon detection of the electrical discharge within the HVAC control box, the device transmits a set of control signals to the controller to stop the operation of the HVAC control box and/or equipment connected to the HVAC control box.

In one or more embodiments, when the electrical discharge event is detected within the HVAC control box upon switching ON of one or more loads associated with the HVAC control box, the device identifies the electrical discharge event as a potential hazard event or a fault condition.

Also described herein is a method for detection of electrical discharge in an HVAC control box. The method comprises the steps of detecting one or more acoustic spectrum within the HVAC control box, and analyzing the detected acoustic spectrum to detect an electrical discharge within the HVAC control box.

In one or more embodiments, the method comprises the steps of matching the detected one or more acoustic spectrum with pre-stored acoustic spectrums associated with one or more known electrical discharge conditions, and correspondingly detecting an electrical discharge event within the HVAC control box upon a positive matching.

In one or more embodiments, the acoustic spectrum generated within the HVAC control box is detected by one or more ultrasonic sensor(s).

In one or more embodiments, the method comprises the steps of storing, in a data recorder, log data comprising one or more of the acoustic spectrum(s) being detected within the HVAC control box, the corresponding detected electrical discharge event, and time stamp and duration of the detected electrical discharge event.

In one or more embodiments, the method comprises the steps of transmitting a set of alert signals to the alert generation unit upon detection of the electrical discharge event within the HVAC control box.

In one or more embodiments, the method comprises the steps of transmitting a set of alert signals to one or more mobile devices associated with one or more users upon detection of the electrical discharge event within the HVAC control box.

In one or more embodiments, the method comprises the steps of transmitting a set of control signals to a controller of the HVAC control box upon detection of the electrical discharge within the HVAC control box, to stop the operation of the HVAC control box and/or equipment connected to the HVAC control box.

In one or more embodiments, when the electrical discharge event is detected within the HVAC control box upon switching ON of one or more loads associated with the HVAC control box, the electrical discharge event is identified as a potential hazard event or a fault condition.

The foregoing summary is illustrative only and is not intended to be in any way limiting. In addition to the illustrative aspects, embodiments, and features described above, further aspects, embodiments, features, and techniques of the invention will become more apparent from the following description taken in conjunction with the drawings.

BRIEF DESCRIPTION OF THE DRAWINGS

The accompanying drawings are included to provide a further understanding of the subject disclosure of this invention and are incorporated in and constitute a part of this specification. The drawings illustrate exemplary embodiments of the subject disclosure and, together with the description, serve to explain the principles of the subject disclosure.

In the drawings, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION

Figure 1:
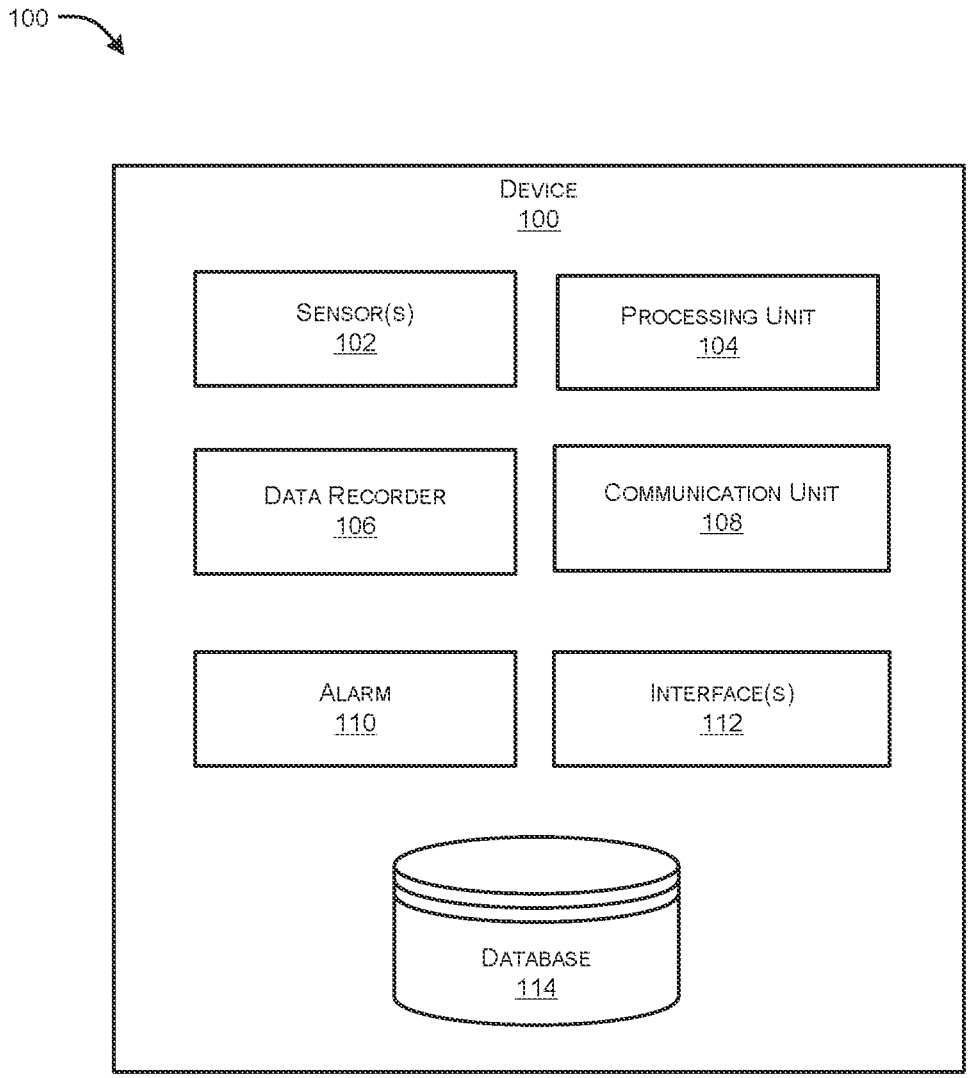
FIG. 1 illustrates an exemplary block diagram of a device for the detection of electrical discharge in a heating, ventilation, and air conditioning (HVAC) control box in accordance with one or more embodiments of the disclosure.

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the subject disclosure as defined by the appended claims.

Various terms are used herein. To the extent a term used in a claim is not defined below, it should be given the broadest definition persons in the pertinent art have given that term as reflected in printed publications and issued patents at the time of filing.

In the specification, reference may be made to the spatial relationships between various components and to the spatial orientation of various aspects of components as the devices are depicted in the attached drawings. However, as will be recognized by those skilled in the art after a complete reading of the subject disclosure, the components of this invention, described herein may be positioned in any desired orientation. Thus, the use of terms such as "above," "below," "upper," "lower," "first", "second" or other like terms to describe a spatial relationship between various components or to describe the spatial orientation of aspects of such components should be understood to describe a relative relationship between the components or a spatial orientation of aspects of such components, respectively, as the HVAC control box, HVAC system, sensor, processing unit, and corresponding components, described herein may be oriented in any desired direction.

Heating, ventilation, and air conditioning (HVAC) systems typically include an HVAC control box or panel implemented for rooftop, heating, and chiller applications. For example, the HVAC box may control the operation and switching of loads/equipment such as a blower motor and an igniter associated with a furnace, and a fan motor and a pump associated with a chiller unit. The HVAC control box switches these high-power loads which may cause a thermal event if an electrical discharge or arc is generated in the HVAC control box during the switching operation of these loads. The electrical discharge may ignite any material within the control box leading to a fire within the control box which may damage the HVAC control box as well as the nearby equipment. This could result in serious or even fatal injuries, and could lead to significant costs associated with investigation, warranty, and liability claims. While the control box may be typically designed to contain a potential thermal event/fire hazard, the electrical discharge events and their timing remain uninvestigated, which may be required for diagnostics and prognostics. There is therefore a need to provide a reliable and efficient solution for the detection of electrical discharges within the HVAC control box, which may also alert service and safety personnel about a potential safety hazard situation and trigger a service call.

This invention provides an efficient, reliable, and compact device and a method for the detection of electrical discharge events and a potential safety hazard situation in an HVAC control box. This invention also alerts service and safety personnel about a potential safety hazard situation and triggers a service call. This invention also logs the recorded electrical discharge events and their timing and duration, which may be useful for investigation purposes.

Figure 3:
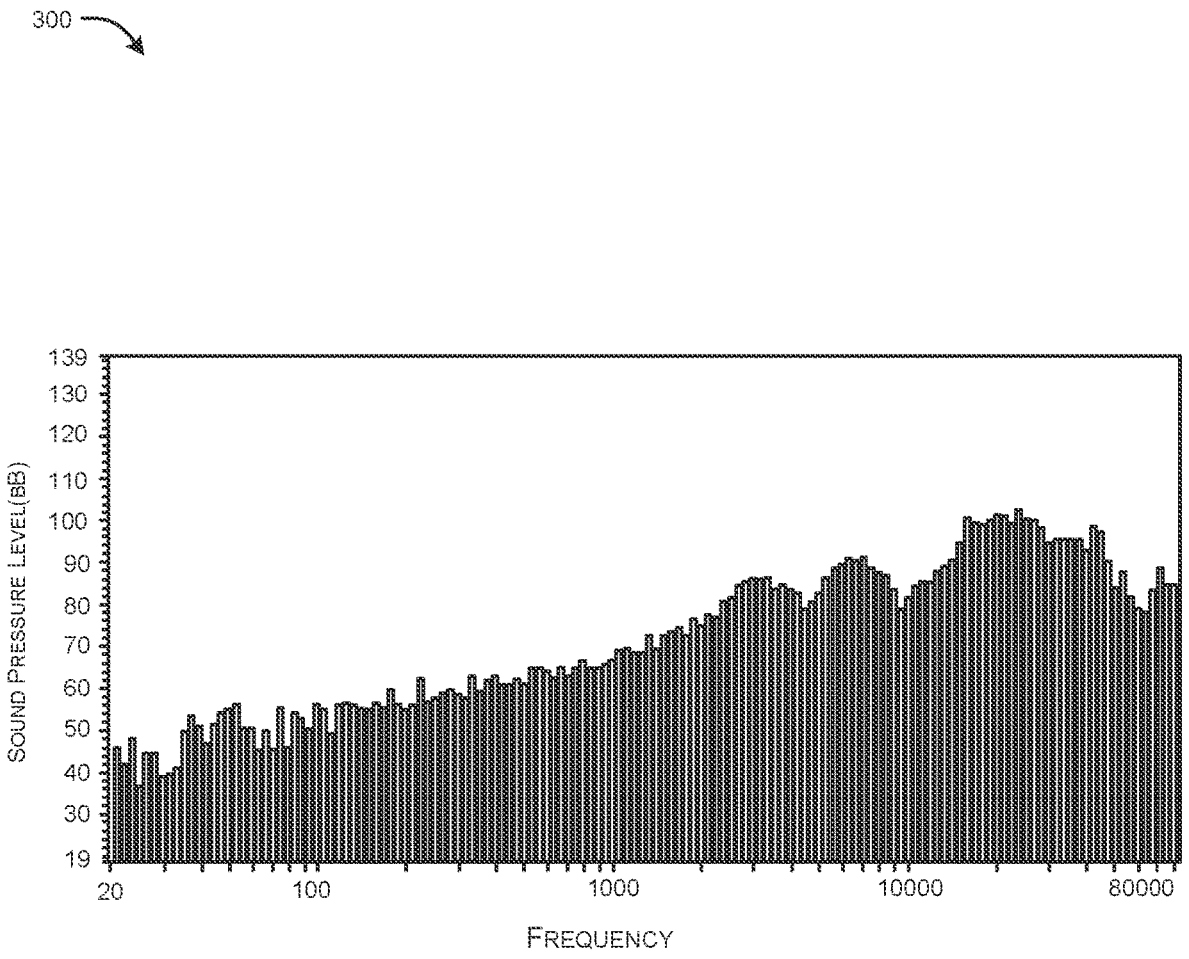
FIG. 3 illustrates an exemplary acoustic spectrum of an electrical discharge produced in proximity to the device to simulate an arc flash event.

Referring to FIG. 1, the device 100 for the detection of electrical discharge and a potential fire hazard event in an HVAC control box is illustrated. The device 100 includes one or more ultrasonic sensor(s) 102 operable to detect one or more acoustic spectrum within the HVAC control box in ultrasonic range. The device 100 further includes a processing unit 104 that is configured to receive the acoustic spectrum being detected within the HVAC control box and analyze the received acoustic spectrum to detect an electrical discharge within the HVAC control box. In one or more embodiments, the processing unit 104 matches the received acoustic spectrum with pre-stored acoustic spectrums associated with one or more known electrical discharge conditions and correspondingly detects an electrical discharge event within the HVAC control box upon a positive matching. Referring to FIG. 3, an exemplary acoustic spectrum 300 produced in proximity to the device 100 to simulate an arc flash event is depicted. The device 100 may identify the acoustic spectrum 300 as an electrical discharge event within the HVAC control box if the acoustic spectrum 300 matches with the pre-stored acoustic spectrums associated with one or more known electrical discharge conditions (positive matching), however, if the acoustic spectrum 300 does not match with the pre-stored acoustic spectrums, the device 100 may identify the acoustic spectrum 300 as a non-electrical discharge or non-arc event (negative matching).

The device 100 is installed at desired positions within the HVAC control box, which allows the ultrasonic sensor(s) 102 to detect the acoustic spectrum generated within the HVAC control box. Further, the ultrasonic sensor(s) 102 is operatively connected to the processing unit 104 via wired media. In one or more embodiments, the ultrasonic sensor(s) 102 remains in communication with the processing unit 104 via wireless media, through a network. In one or more embodiments, the ultrasonic sensor 102 may be a micro-electro-mechanical system (MEMS) based ultrasonic microphone but is not limited to the like. The components of the device 100 may be safely enclosed in a fire-safe casing to prevent the device 100 from getting damaged by fire.

The device 100 further includes a data recorder 106 that stores log data comprising one or more of the acoustic spectrum being detected within the HVAC control box, the corresponding detected electrical discharge event, and the time stamp and duration of the detected electrical discharge event. The data recorder 106 may be secured within a casing/housing of the device 100 along with the ultrasonic sensor(s) 102 and the processing unit 104. In one or more embodiments, the data recorder 106 may be secured outside the HVAC control box. Further, the data recorder 106 may be operatively connected to the processing unit 104 via wired media. In one or more embodiments, the data recorder 106 may remain in communication with the processing unit 104 via wireless media, through a network.

The device 100 further includes a communication unit 108 (such as a transceiver 108), and an alert generation unit (alarm) 110 being configured within a single housing along with the processing unit 104, ultrasonic sensor(s) 102, and data recorder 106, which can be easily positioned at a predefined location within the HVAC control box. The processing unit 104 is operatively coupled to the ultrasonic sensor(s) 102, the data recorder 106, the transceiver 108, the alarm 110. A processor and a memory collectively form the processing unit 104, where the processor includes suitable logic, circuitry, and/or interfaces that are operable to execute one or more instructions stored in the memory to perform predefined operations. The memory may be operable to store one or more instructions. The processor may be implemented using the processors known in the art. Some of the commonly known memory implementations include, but are not limited to, a random access memory (RAM), a read only memory (ROM), a hard disk drive (HDD), and a secure digital (SD) card. Further, the memory includes the one or more instructions that are executable by the processor to perform specific operations. It is apparent to a person having ordinary skills in the art that the one or more instructions stored in the memory enable the hardware of the device 100 to perform the predefined operations.

A database 114 associated with the device 100 is pre-stored with the list of acoustic spectrums associated with one or more known electrical discharge conditions, along with the severity level of the electrical discharge conditions. In one or more embodiments, the database 114 can be associated with the device 100 and reside in the same device 100 for offline operation. In other embodiments, the database 114 can be associated with a central server that remains in communication with the processing unit 104 of the device 100.

The device 100 also comprises an interface(s) 112 that may comprise a variety of interfaces, for example, interfaces for connecting the device 100 to a power source or to the HVAC control box, and interfaces for data input and output devices such as the data recorder 106 and a display referred to as I/O devices, storage devices, and the like. The device 100 further includes the communication unit 108 such as WiFi module, transceiver, Bluetooth module, cellular connection module such as 2G, 3G, 4G, and 5G, and the like to facilitate communication of the device 100 with a fire system or alarm system of a location where the HVAC control box is located, and mobile devices associated with users, and safety and service personnel of the invention, and a central server through the network. The mobile device may include smartphones, laptops, tablets, hand-held computing devices, computers, and the like. The interface(s) 112 may also provide a communication pathway for one or more internal components or units of the device 100. Examples of such internal components include, but are not limited to, the sensor(s) 102, processing unit 104, database 114, and alarm unit 110 of the device 100.

In one or more embodiments, the processing unit 104 is configured to transmit a set of alert signals to the alert generation unit (alarm) 110 upon detection of the electrical discharge event within the HVAC control box. The device 100 further transmits the set of alert signals to the mobile devices of the users or to the fire detection and alarm system of the location where the HVAC control box is installed, to trigger a service and/or safety call, which may help mitigate a fire hazard or fault event.

In one or more embodiments, upon detection of the electrical discharge within the HVAC control box, the device 100 is configured to transmit a set of control signals to the controller to stop the operation of the HVAC control box and/or equipment connected to the HVAC control box. This may help stop the operation of the HVAC control box and/or equipment being connected to the HVAC control box to avoid further damage to the HVAC system and corresponding components.

In one or more embodiments, when the electrical discharge event is detected within the HVAC control box upon switching ON of one or more loads associated with the HVAC control box, the device 100 identifies the electrical discharge event as a potential hazard event or a fault condition and correspondingly transmit the alert signals and/or the control signals. Accordingly, the device's 100 capability to identify when loads associated with the HVAC control box are switched (i.e. when electrical discharges should or should not be present within the box), can aid in the determination of a potential hazard situation and also eliminate false triggering of the device 100.

The communication unit 108 (transceiver) enables the processing unit 104 to receive the captured/detected acoustic spectrum from the ultrasonic sensors 102 for further analysis and detection of the electrical discharge event. Further, the communication unit 108 enables the device 100 to transmit and store the recorded log data in the data recorder 106 and further enables the device 100 to transmit the stored log data from the data recorder 106 to the central server, the mobile devices of the users, and the safety and service personnel for diagnostic and prognostic purposes. The communication unit 108 also enables the device 100 to transmit alert signals to the mobile devices of the users or to the fire detection and alarm system of the location where the HVAC control box is installed, to trigger a service and/or safety call. Furthermore, the communication unit 108 enables the device 100 to transmit control signals to the controller associated with the HVAC control box to stop the operation of the HVAC control box and/or equipment being connected to the HVAC control box to avoid further damage to the HVAC system and corresponding components. Examples of the transceiver may include but are not limited to, an antenna, an Ethernet port, an USB port, or any other port that can be configured to transmit the captured data. The transceiver transmits data in accordance with the various communication protocols, such as TCP/IP, UDP, and 2G, 3G, or 4G communication protocols.

The alert generation unit (alarm) of the device 100 includes an LED, a siren, and/or a buzzer. The device 100 upon detection of electrical discharge within the HVAC box triggers the alarm of the device 100 or the fire detection and alarm system of the location where the HVAC control box is installed to alert about the detected electrical discharge and a potential fire hazard situation. The device 100 further includes a power source such as a battery that is within the housing of the device 100 to supply electrical power to the components of the device 100. Besides, the device 100 may also be electrically connected to a power source of the HVAC control box or the HVAC system.

Figure 2:
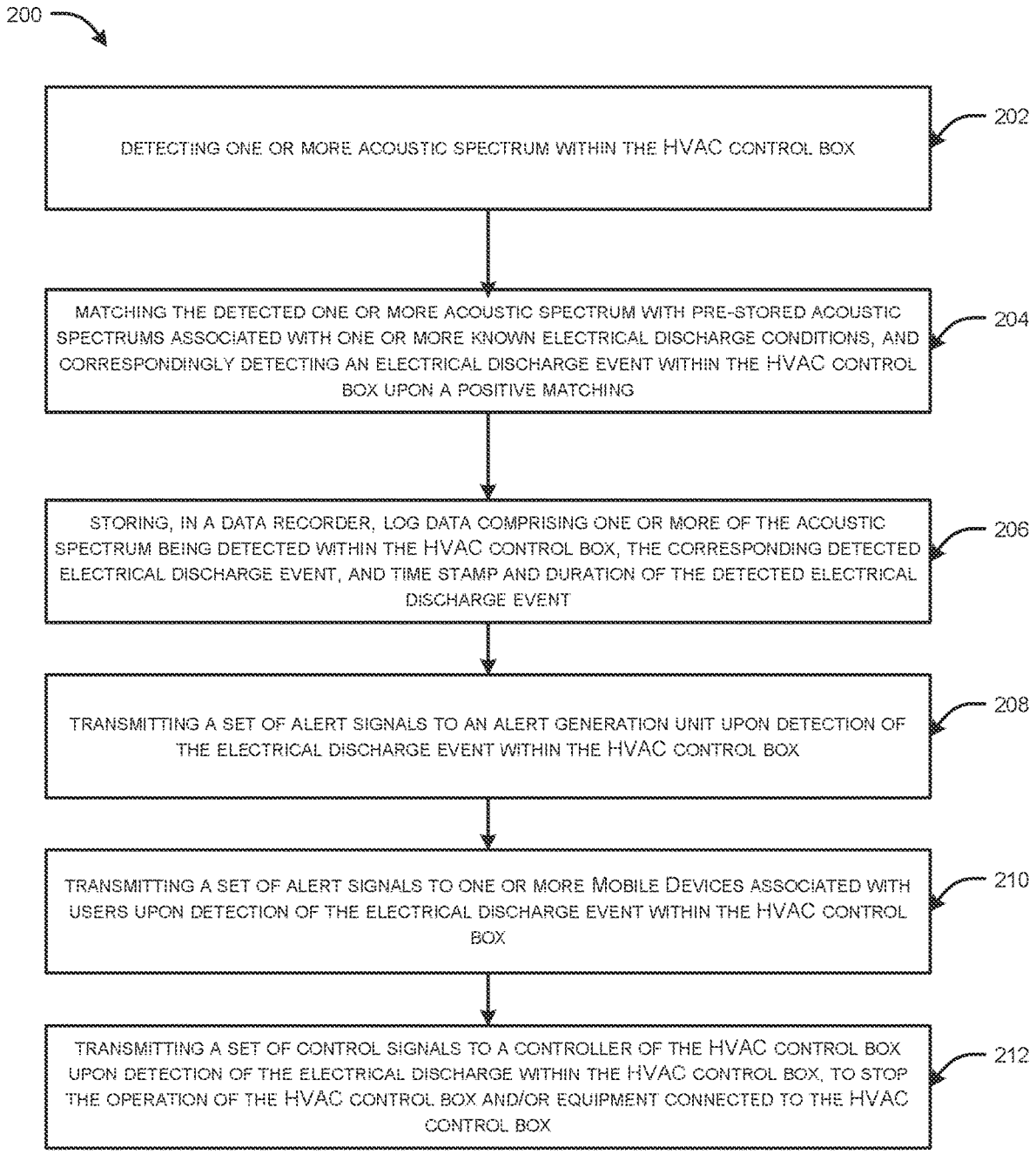
FIG. 2 illustrates an exemplary flow diagram of the method for detection of electrical discharge in an HVAC control box in accordance with one or more embodiments of the disclosure.

Referring to FIG. 2, an exemplary flow diagram of method 200 for the detection of electrical discharge in an HVAC control box is disclosed, Method 200 comprises step 202 of detecting the acoustic spectrum(s) generated within the HVAC control box using one or more ultrasonic sensor including but is not limited to a micro-electro-mechanical system (MEMS) based ultrasonic microphone. Method 200 further includes step 204 of analyzing the detected acoustic spectrum to detect an electrical discharge within the HVAC control box.

In one or more embodiments, step 204 involves matching the detected acoustic spectrum with pre-stored acoustic spectrums associated with one or more known electrical discharge conditions, and correspondingly detecting an electrical discharge event within the HVAC control box upon a positive matching.

In one or more embodiments, method 200 further comprises step 206 of storing, in a data recorder, a log data comprising one or more of the acoustic spectrum being detected within the HVAC control box, the corresponding detected electrical discharge event, and the time stamp and duration of the detected electrical discharge event.

In one or more embodiments, method 200 comprises the steps 208 of transmitting a set of alert signals to the alert generation unit upon detection of the electrical discharge event within the HVAC control box. In one or more embodiments, method 200 further comprises step 210 of transmitting a set of alert signals to one or more mobile devices associated with one or more users upon detection of the electrical discharge event within the HVAC control box.

In one or more embodiments, method 200 comprises step 212 of transmitting a set of control signals to a controller of the HVAC control box upon detection of the electrical discharge within the HVAC control box, to stop the operation of the HVAC control box and/or equipment connected to the HVAC control. This may help stop the operation of the HVAC control box and/or equipment being connected to the HVAC control box to avoid further damage to the HVAC system and corresponding components.

In one or more embodiments, when the electrical discharge event is detected within the HVAC control box upon switching ON of one or more loads associated with the HVAC control box, the electrical discharge event is identified as a potential hazard event or a fault condition. This capability of identification and discrimination of events (i.e., when electrical discharges should or should not be present within the box), can aid in the determination of a potential hazard situation and also eliminate false triggering.

It should be obvious to a person skilled in the art that while various embodiments and examples of this invention have been elaborated for the use of the device and method of this invention for the detection of electrical discharge in an HVAC control box, however, the teachings of this invention are equally applicable to other electrical and electronic devices or power electronic devices where electrical discharge events may occur, and all such embodiments are well within the scope of this invention.

Thus, this invention overcomes the drawbacks, limitations, and shortcomings associated with existing technologies by providing an efficient, reliable, and compact device and a method for the detection of electrical discharge events and a potential safety hazard situation in an HVAC control box. In addition, the device also alerts service and safety personnel about a potential safety hazard situation and triggers a service call. Moreover, the device logs the recorded electrical discharge events and their timing and duration in a data recorder, which may be useful for investigation purposes.

While the invention has been described with reference to exemplary embodiments, it will be understood by those skilled in the art that various changes may be made and equivalents may be substituted for elements thereof without departing from the scope of the invention as defined by the appended claims. Modifications may be made to adopt a particular situation or material to the teachings of the invention without departing from the scope thereof. Therefore, it is intended that the invention not be limited to the particular embodiment disclosed, but that the invention includes all embodiments falling within the scope of the invention as defined by the appended claims.

In interpreting the specification, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

The invention claimed is:

1. A device for detection of electrical discharge in an HVAC control box, the device comprising:

one or more ultrasonic sensor operable to detect one or more acoustic spectrum within the HVAC control box; and a processing unit in communication with the one or more ultrasonic sensor, the processing unit comprises a processor coupled to a memory storing instructions executable by the processor, wherein the processing unit is configured to:

receive, from the one or more ultrasonic sensor, the one or more acoustic spectrum being detected within the HVAC control box;

analyze the received acoustic spectrum to detect an electrical discharge within the HVAC control box;

determine, based at least in part on a switching state of one or more loads associated with the HVAC control box, whether electrical discharges should or should not be present within the HVAC control box, and identify the detected electrical discharge as a potential hazard event or a fault condition when electrical discharges are determined to not be present within the HVAC control box.

2. The device of claim 1, wherein the processing unit is configured to match the received acoustic spectrum with pre-stored acoustic spectrums associated with one or more known electrical discharge conditions, and correspondingly detect an electrical discharge event within the HVAC control box upon a positive matching.

3. The device of claim 1, wherein the ultrasonic sensor is a micro-electro-mechanical system (MEMS) based ultrasonic microphone.

4. The device of claim 1, wherein the device comprises a data recorder in communication with the processing unit, wherein the processing unit stores log data comprising one or more of the acoustic spectrum being detected within the HVAC control box, the corresponding detected electrical discharge event, and time stamp and duration of the detected electrical discharge event, in the data recorder.

5. The device of claim 4, wherein the data recorder is outside the HVAC control box.

6. The device of claim 1, wherein the device comprises an alert generation unit in communication with the processing unit, wherein the processing unit transmits a set of alert signals to the alert generation unit upon detection of the electrical discharge event within the HVAC control box.

7. The device of claim 1, wherein the device is configured to transmit a set of alert signals to one or more mobile devices associated with one or more users upon detection of the electrical discharge event within the HVAC control box.

8. The device of claim 1, wherein the device is in communication with a controller of the HVAC control box, wherein upon detection of the electrical discharge within the HVAC control box, the device transmits a set of control signals to the controller to stop the operation of the HVAC control box and/or equipment connected to the HVAC control box.

9. The device of claim 1, wherein when the electrical discharge event is detected within the HVAC control box upon switching ON of one or more loads associated with the HVAC control box, the device identifies the electrical discharge event as a potential hazard event or a fault condition.

10. The device of claim 2, wherein the pre-stored acoustic spectrums are stored in association with respective severity levels, and wherein the processing unit is configured, upon the positive matching, to determine a severity level for the detected electrical discharge event and to select, based on the severity level, at least one mitigation action.

11. The device of claim 6, wherein the set of alert signals is transmitted to a building fire detection and alarm system at a location where the HVAC control box is installed.

12. The device of claim 1, wherein at least the processing unit and the one or more ultrasonic sensor are enclosed in a fire-safe casing.

13. A method for detection of electrical discharge in an HVAC control box, the method comprises the steps of:

detecting one or more acoustic spectrum within the HVAC control box;

analyzing the detected acoustic spectrum to detect an electrical discharge within the HVAC control box;

determining, based at least in part on a switching state of one or more loads associated with the HVAC control box, whether electrical discharges should or should not be present within the HVAC control box; and identifying the electrical discharge event as a potential hazard event or a fault condition when electrical discharges are determined to not be present within the HVAC control box.

14. The method of claim 13, wherein the method comprises the steps of matching the detected one or more acoustic spectrum with pre-stored acoustic spectrums associated with one or more known electrical discharge conditions, and correspondingly detecting an electrical discharge event within the HVAC control box upon a positive matching.

15. The method of claim 13, wherein the acoustic spectrum generated within the HVAC control box is detected by one or more ultrasonic sensor.

16. The method of claim 13, wherein the method comprises the steps of storing, in a data recorder, log data comprising one or more of the acoustic spectrum being detected within the HVAC control box, the corresponding detected electrical discharge event, and time stamp and duration of the detected electrical discharge event.

17. The method of claim 13, wherein the method comprises the steps of transmitting a set of alert signals to an alert generation unit upon detection of the electrical discharge event within the HVAC control box.

18. The method of claim 13, wherein the method comprises the steps of transmitting a set of alert signals to one or more mobile devices associated with one or more users upon detection of the electrical discharge event within the HVAC control box.

19. The method of claim 13, wherein the method comprises the steps of transmitting a set of control signals to a controller of the HVAC control box upon detection of the electrical discharge within the HVAC control box, to stop the operation of the HVAC control box and/or equipment connected to the HVAC control box.

20. The method of claim 13, wherein when the electrical discharge event is detected within the HVAC control box upon switching ON of one or more loads associated with the HVAC control box, the electrical discharge event is identified as a potential hazard event or a fault condition.

* * * * *